US007934610B2

(12) United States Patent
Zeng

(10) Patent No.: US 7,934,610 B2
(45) Date of Patent: May 3, 2011

(54) MAGNETIC KNIFE SUPPORTER

(76) Inventor: Lingdong Zeng, Zhongshan (CN)

( * ) Notice: Subject to any disclaimer, the term of this patent is extended or adjusted under 35 U.S.C. 154(b) by 615 days.

(21) Appl. No.: 11/975,576

(22) Filed: Oct. 20, 2007

(65) Prior Publication Data

US 2009/0101607 A1 Apr. 23, 2009

(51) Int. Cl.
*A47F 7/00* (2006.01)

(52) U.S. Cl. ..... 211/70.7

(58) Field of Classification Search ..... 211/70.7, 211/DIG. 1; 220/483; 24/303; 206/818; 248/683, 206.5, 309.4, 350; 269/8
See application file for complete search history.

(56) References Cited

U.S. PATENT DOCUMENTS

| | | | | | |
|---|---|---|---|---|---|
| 2,620,929 | A * | 12/1952 | Sportsman | 108/28 |
| 2,740,530 | A * | 4/1956 | Ponder | 211/64 |
| 2,959,293 | A * | 11/1960 | Von Meyer | 211/40 |
| 4,071,212 | A * | 1/1978 | Burrows et al. | 248/37.6 |
| 4,294,421 | A * | 10/1981 | Kunstlicher et al. | 211/70.6 |
| 4,497,412 | A * | 2/1985 | Labelle | 211/70.7 |
| 4,537,315 | A * | 8/1985 | Griffin | 211/70.6 |
| 4,586,616 | A * | 5/1986 | Cooper et al. | 211/88.04 |
| 4,970,006 | A * | 11/1990 | Martinez | 248/37.3 |
| 5,011,102 | A * | 4/1991 | Kiefer | 248/37.3 |
| 5,228,578 | A * | 7/1993 | Wu | 211/43 |
| 5,301,822 | A * | 4/1994 | Coleman et al. | 211/70.6 |
| 5,375,337 | A * | 12/1994 | Butler | 33/506 |
| 5,544,747 | A * | 8/1996 | Horn | 206/378 |
| 5,669,516 | A * | 9/1997 | Horn | 211/70.6 |
| 6,216,888 | B1 * | 4/2001 | Chien | 211/87.01 |
| 6,719,155 | B1 * | 4/2004 | Chang | 211/70.6 |
| 7,210,588 | B1 * | 5/2007 | Ayon et al | 211/70.7 |
| 7,448,506 | B2 * | 11/2008 | Berti | 211/70.7 |
| 7,584,861 | B2 * | 9/2009 | Werner | 211/64 |
| 2002/0175131 | A1 * | 11/2002 | Johnson | 211/70.7 |
| 2008/0060205 | A1 * | 3/2008 | Schmidt et al. | 30/298.4 |

* cited by examiner

*Primary Examiner* — Jennifer E. Novosad

(57) ABSTRACT

The knife supporter comprises at least two magnetic boards has same magnetic polarity at inner side facing each other, so that the magnetic boards repel each other, and a supporting frame slidably supports the magnetic boards, so that the magnetic board can slide along the supporting frame for magnetic the knife therebetween, whereby when a knife is put between the two magnetic boards, the magnetic boards with magnetism can attract the knife and clamp the knife tightly therebetween, when no knife is put between the two magnetic boards, the magnetic boards are separated due to same magnetic polarity repelling each other.

20 Claims, 8 Drawing Sheets

MAGNETIC KNIFE SUPPORTER

BACKGROUND OF THE PRESENT INVENTION

1. Field of Invention

The present invention relates to a knife supporter, and more particularly to a knife supporter which can hold knives of any size and of any number, and has the advantage of convenient to use and easy to clean.

2. Description of Related Arts

In the kitchen, many kinds of knives are needed, such as kitchen knife, table knife, but where to put away these knives is a tough problem. People usually put the knife on the table or in the cupboard which is not safe, and the knife can be easily stained.

Then knife supporter is developed. The present knife supporter comprises a base having a plurality of receiving slots thereon for receiving knives therein. The base is usually made of wood. The size of the receiving slots is predetermined, and the receiving slots have different sizes for receiving knives of different sizes. Moreover, the number of the receiving slot is predetermined too, so that the knife supporter can only receive a predetermined number of knives.

The inconvenient of the present knife supporter is obvious. When more knives are bought, the knife supporter has not place to hold them, because the traditional knife supporter has only limited resources. When the knife is bigger or thicker than the receiving slot of the knife supporter, the knife supporter can not be used, and when the receiving slot is too large for the knife, the knife will sway in the receiving slot, which is not safe. Further more, when only big knife is used, then the pre-designed small receiving slot has not use, which is a kind of waste.

In addition, the traditional knife supporter is not easy to be cleaned. The receiving slot is very deep for receiving knives, and the deep receiving slot can not be cleaned thoroughly. For the knife are used to prepare food, such a knife supporter is not good for health.

Therefore, an innovative knife supporter is expected, and the knife supporter that can overcome the above drawbacks surely can be very popular in the market.

SUMMARY OF THE PRESENT INVENTION

A main object of the present invention is to provide a knife supporter which can hold knives of any sizes.

Another object of the present invention is to provide knife supporter which can hold knives of changeable number by adding or reducing rooms for knives.

Another object of the present invention is to provide knife supporter which can be easily cleaned.

Accordingly, in order to accomplish the above object, the present invention provides a knife supporter comprises:

at least two magnetic boards with same magnetic polarity facing each other, so that when a knife is put between the two magnetic boards, the magnetic boards with magnetism can clamp the knife tightly therebetween, when no knife is put between the two magnetic boards, the magnetic boards are separated due to same magnetic polarity facing each other, and a supporting frame slidably supporting the magnetic boards, so that the magnetic board can slide along the supporting frame, so that the magnetic board can slide together for magnetic the knife therebetween.

These and other objectives, features, and advantages of the present invention will become apparent from the following detailed description, the accompanying drawings, and the appended claims.

DETAILED DESCRIPTION OF THE PREFERRED EMBODIMENT

Figure 1:
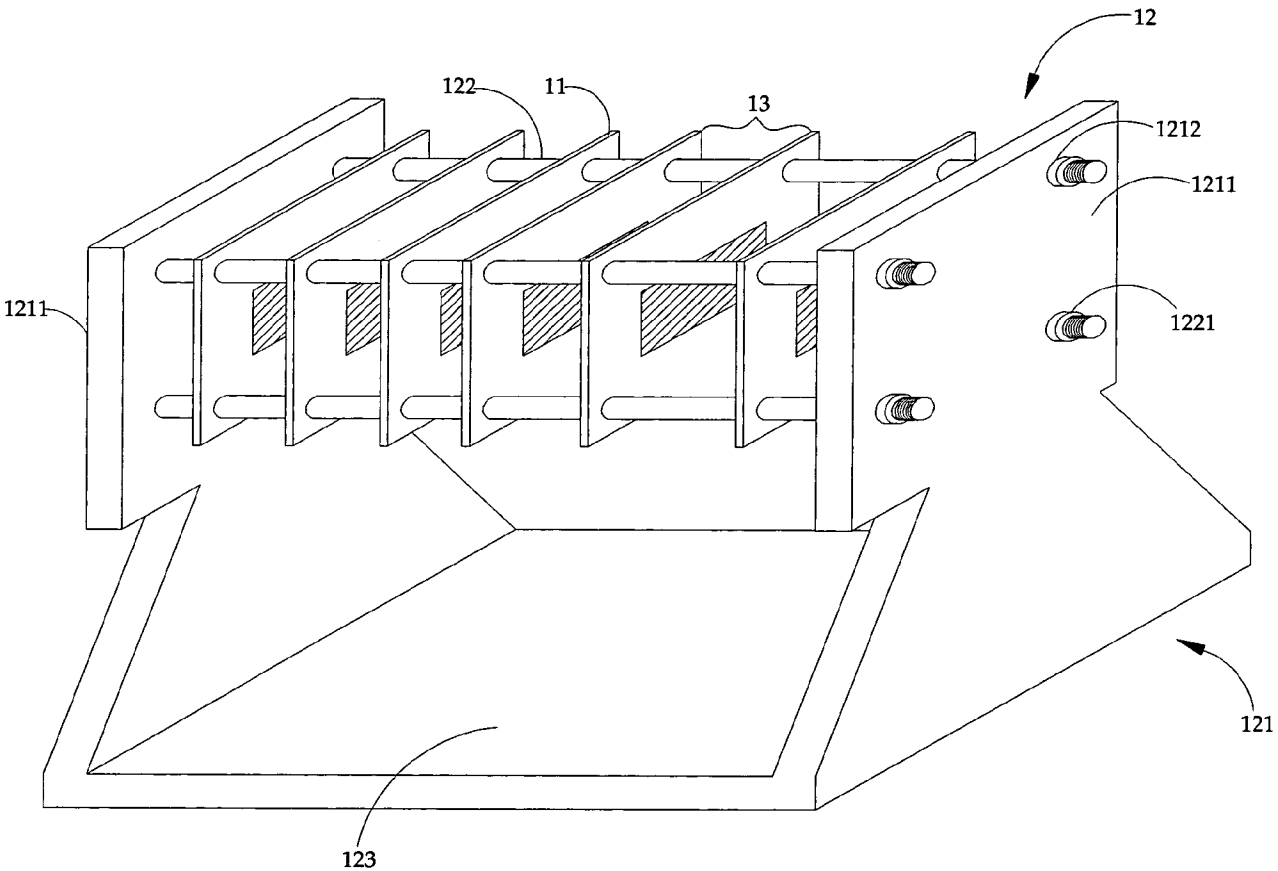
FIG. 1 is a perspective view of a knife supporter according to a preferred embodiment of the present invention.
Figure 1B:
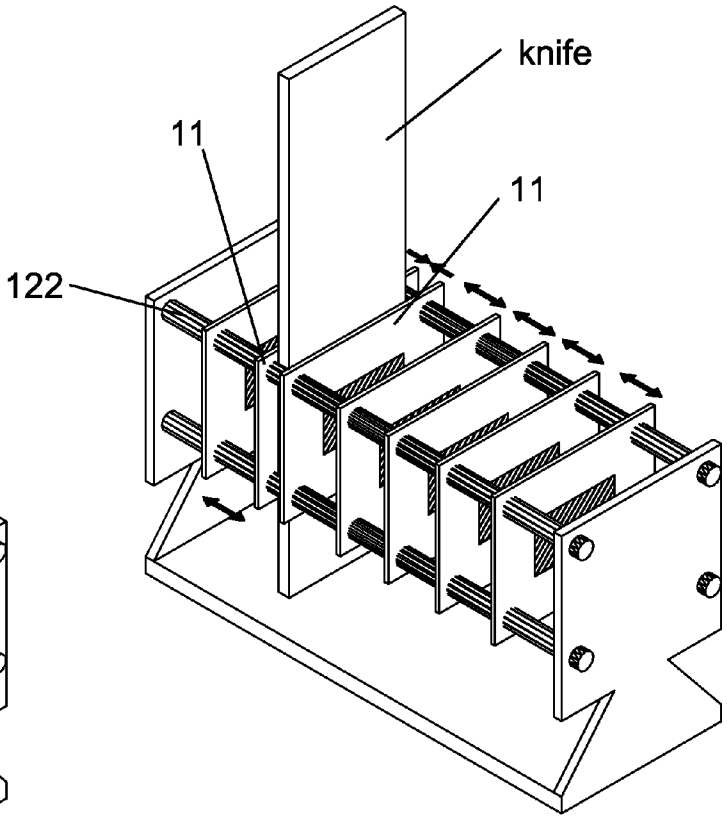
FIGS. 1A-1B are schematic views of the knife supporter according to the above preferred embodiment of the present invention, illustrating attracting a knife thereto.
Figure 1A:
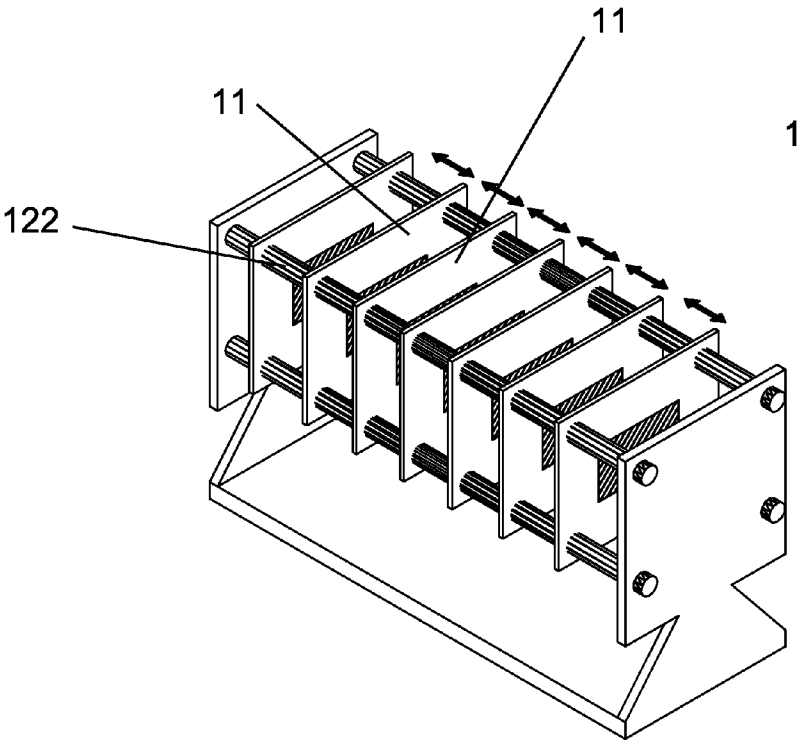
Figure 2:
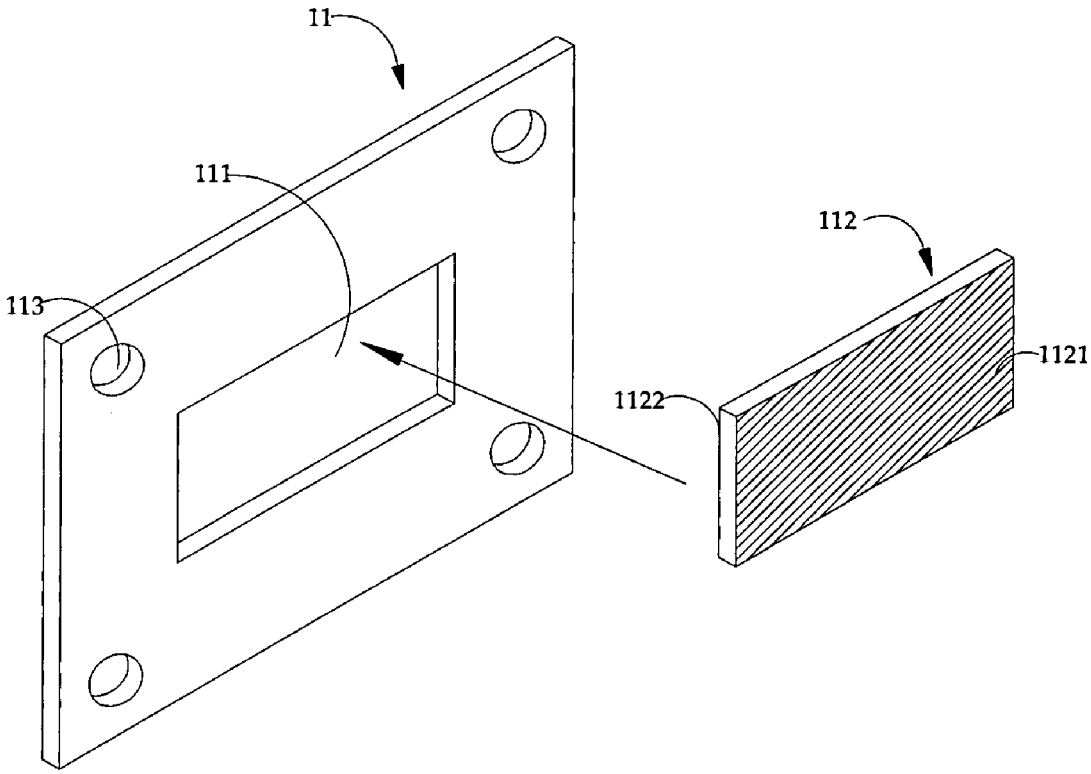
FIG. 2 is a perspective view of a magnetic board of knife supporter according to the above preferred embodiment of the present invention.

Referring to FIG. 1 and FIG. 2 of the drawings, a knife supporter according to the preferred embodiment of the present invention is illustrated, in which the knife supporter comprises:

at least two magnetic boards 11 has same magnetic polarity facing each other, so that the magnetic boards repel each other forming a receiving room 13 therebetween for holding knife, and a supporting frame 12 slidably supports the magnetic boards, so that the magnetic board can slide along the supporting frame for clamping knife therebetween, whereby when a knife is put between two magnetic boards, the magnetic boards with magnetism can attract and clamp knife tightly therebetween, when no knife is put between the two magnetic boards, the magnetic boards are separated due to same magnetic polarity repelling each other.

Two magnetic boards 11 just have one room 13 for holding knife, so that more magnetic boards used in the present invention are preferred. The magnetic boards can be mounted in parallel one and another on the supporting frame, so as to holding knives therebetween. Moreover, the magnetic boards can be detachably mounted on the supporting frame, so that the number of the magnetic boards is changeable. When more knives are bought, more magnetic boards can be mounted on the supporting frame for supporting more knives.

Figure 3:
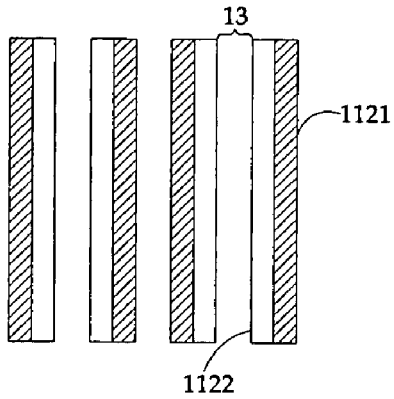
FIG. 3 is a schematic view of several magnetic arranged together according to a preferred embodiment of the present invention.

The magnetic board 11 can be made of magnet. Alternatively, the magnetic board 11 can be made of wood or plastic and so on, and the magnetic board having at least one hole 111 thereon for receiving a magnet 112. The magnet 112 has a front side 1121 and a rear side 1122 wherein the front side and the rear side have opposite magnetic polarity due to its own property. As shown in FIG. 3, when the first magnet and the second magnet have front side facing each other, so that they can repel each other, and then the third magnet has a rear side facing the rear side of the second magnet, and the fourth magnet has a front side facing the front side of the third magnet. Then more magnets can be set by inference. Therefore, each two adjacent magnetic board repel each other, so that more receiving rooms for receiving knives are formed. It is worth mentioning that the magnet can also be embodied as an electromagnetic coil.

Alternatively, the magnetic board 11 can be made of wood or plastic and so on, and the magnetic board 11 comprises magnet 112 attached to the side of the magnetic board. The magnetic board 11 can comprises two magnets 112 attached to both sides of the magnetic board. All the magnets have same magnetism polarity facing outside, such as North Pole. Therefore, no magnetism polarity of the magnetic board side has to be considered, when mounting the magnetic board on the supporting frame.

The supporting frame comprises a base 121 having two upright side walls 1211 spacedly apart from each other, and at least one guiding pole 122 mounted between the two upright side walls 1211. The magnetic boards 11 have at least one hole 113 thereon for receiving the guiding pole passing through, so that the magnetic boards can slidably mounted on the connecting pole on the supporting frame.

Moreover, the magnetic boards can detachably mounted on the supporting frame, so that more magnetic boards can be added thereon, and the magnetic board can be detached to be cleaned thoroughly. The two upright side walls 1211 have at least one hole respectively for fixing the guiding pole. The supporting frame further comprises at least one screw 1221 for secure at least one end of the connecting pole on the upright side wall, and the guiding pole has thread in the end for the screw screwing on. Alternatively, the guiding pole can be welded on the upright side walls.

In the preferred embodiment, the supporting frame comprises four guiding poles 122, and the magnetic board 11 is of rectangular shape and has four holes 113 at each corner for receiving the guiding poles passing through. The two upright side walls have four holes 1212 at corresponding place with the holes on the magnetic board when the magnetic board is mounted on the supporting frame, so that the guiding poles connect the magnetic boards to the upright side walls and the magnetic boards can slide along the guiding poles. The four screws secure the connecting poles respectively to the upright side walls.

The base 121 further comprises a bottom plate 123 for supporting the two upright side walls on both ends of the bottom plate respectively. Because the knives are heavy, a strong base can support the knife supporter from falling off, when the knife supporter is fully loaded with knives.

Figure 4:
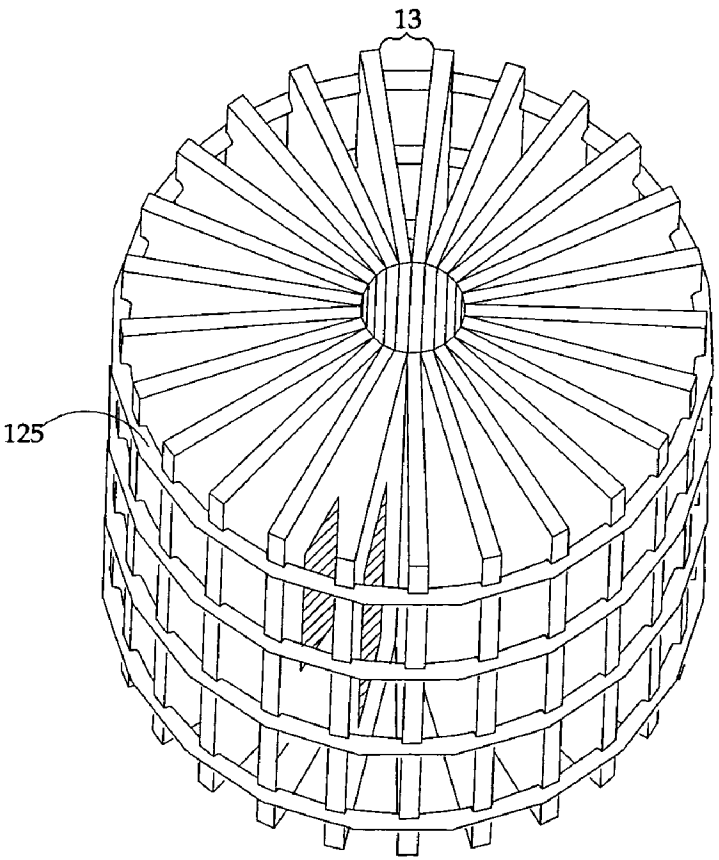
FIG. 4 is a perspective view of an alternative of a knife supporter according to the above preferred embodiment of the present invention.
Figure 4B:
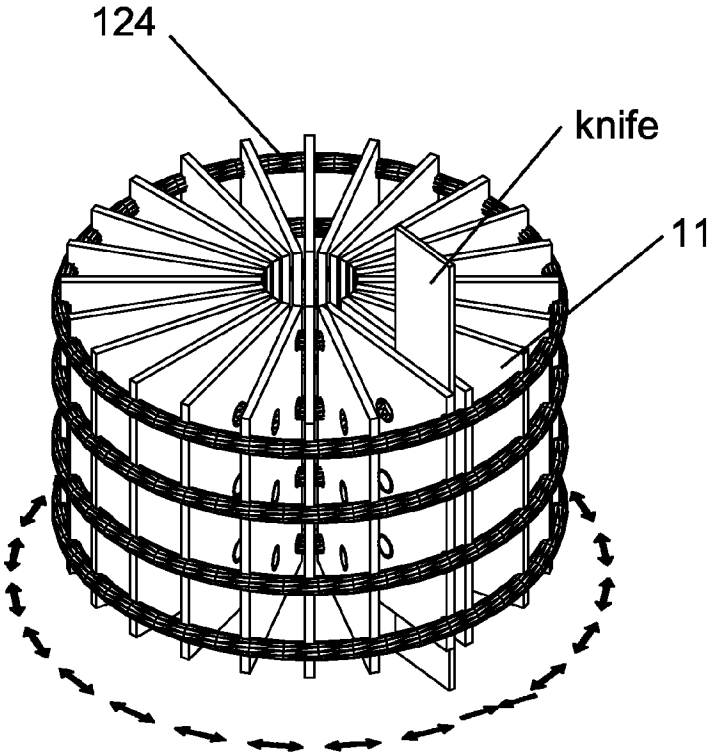
FIGS. 4A-4B are schematic views of the knife supporter according to the above preferred embodiment of the present invention, illustrating attracting a knife thereto.
Figure 4A:
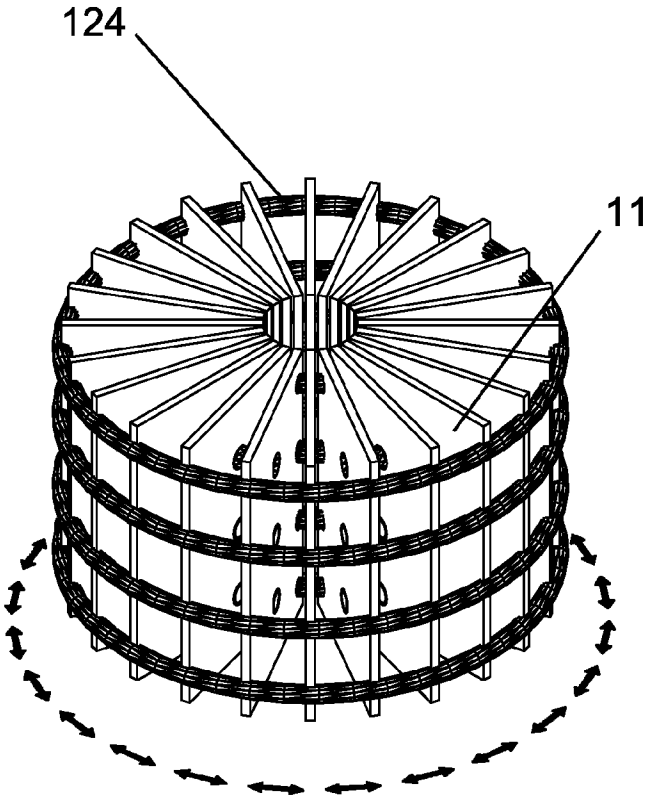
Figure 5:
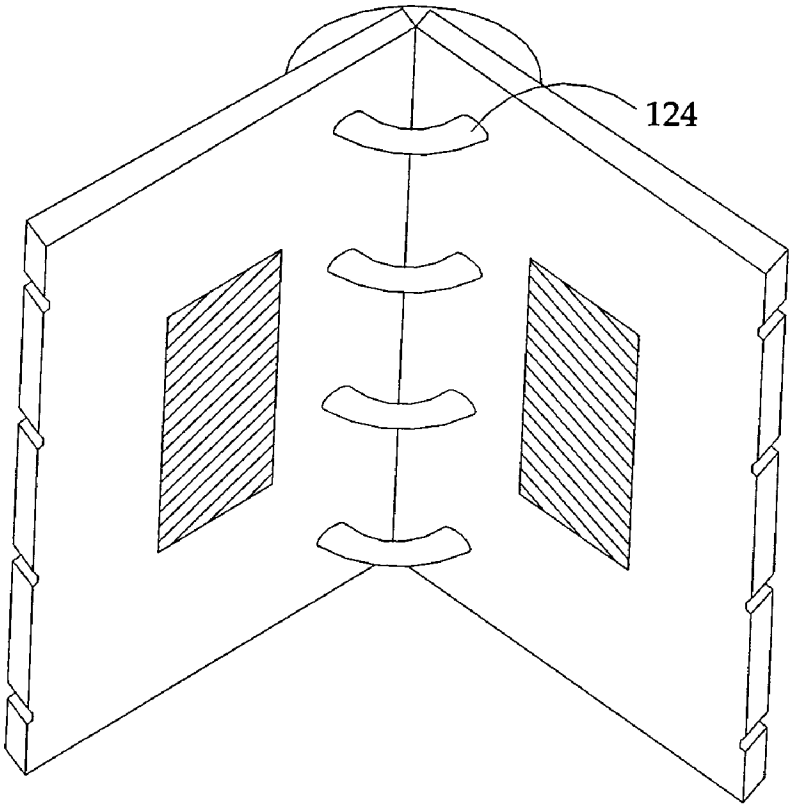
FIG. 5 is a perspective view of a magnetic board of the knife supporter in FIG. 4 according to the above preferred embodiment of the present invention.
Figure 5:
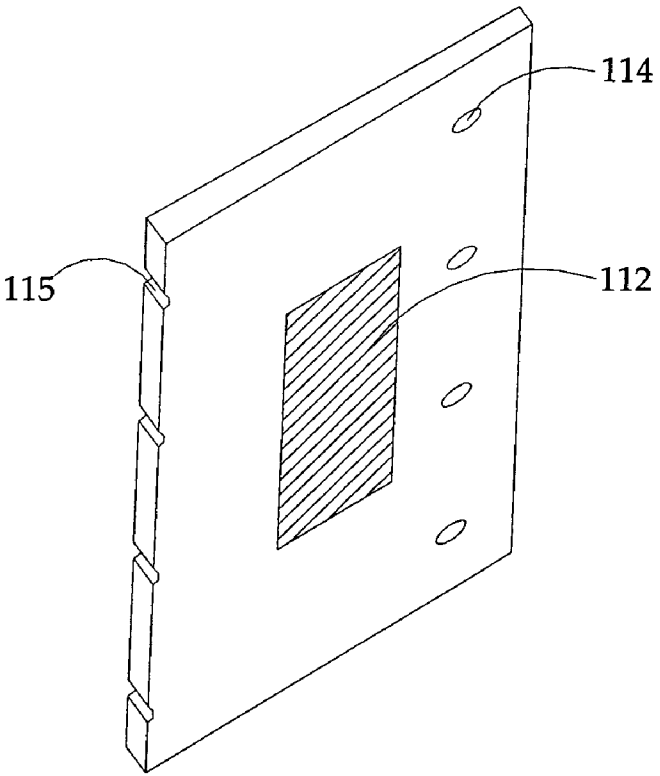

Alternatively, referring to FIG. 4 and FIG. 5, the supporting frame 12 comprises at least one connecting ring 124 which can connect the magnetic boards 11 on one side forming a circle, and at least one guiding ring 125 guides the magnetic boards on the other side. At the same time, the magnetic board has at least one hole 114 for connecting ring passing through forming a circle, and the magnetic board further has a groove 115 on the other side for guiding the magnetic boards sliding along the guiding ring.

Therefore, every two magnetic boards have a room 13 for magnetic a knife therebetween, and the supporting frame and the magnetic boards can stand on the ground by themselves. Preferably, more magnetic boars should be used, so that the magnetic board can form a circle, and more rooms are available for holding knives. It is worth mentioning that both the connecting ring 124 and the guiding ring 125 can have a joint that can detach the ring therefrom, so that the clamping board can be detached from the supporting frame. The connecting ring and the guiding ring can be made of flexible material, such as iron wire or plastic belt.

In this alternative embodiment, the magnetic board 11 has four holes 114 spacedly apart in a straight vertical line on one side of the magnetic board, and further has four grooves 115 spacedly apart on the edge of the other side of the magnetic board. The supporting frame comprises four connecting rings 124 connect the magnetic board by four holes on magnetic board respectively, and further comprises four guiding rings 125 surrounding the other side of the magnetic boards.

Figure 6:
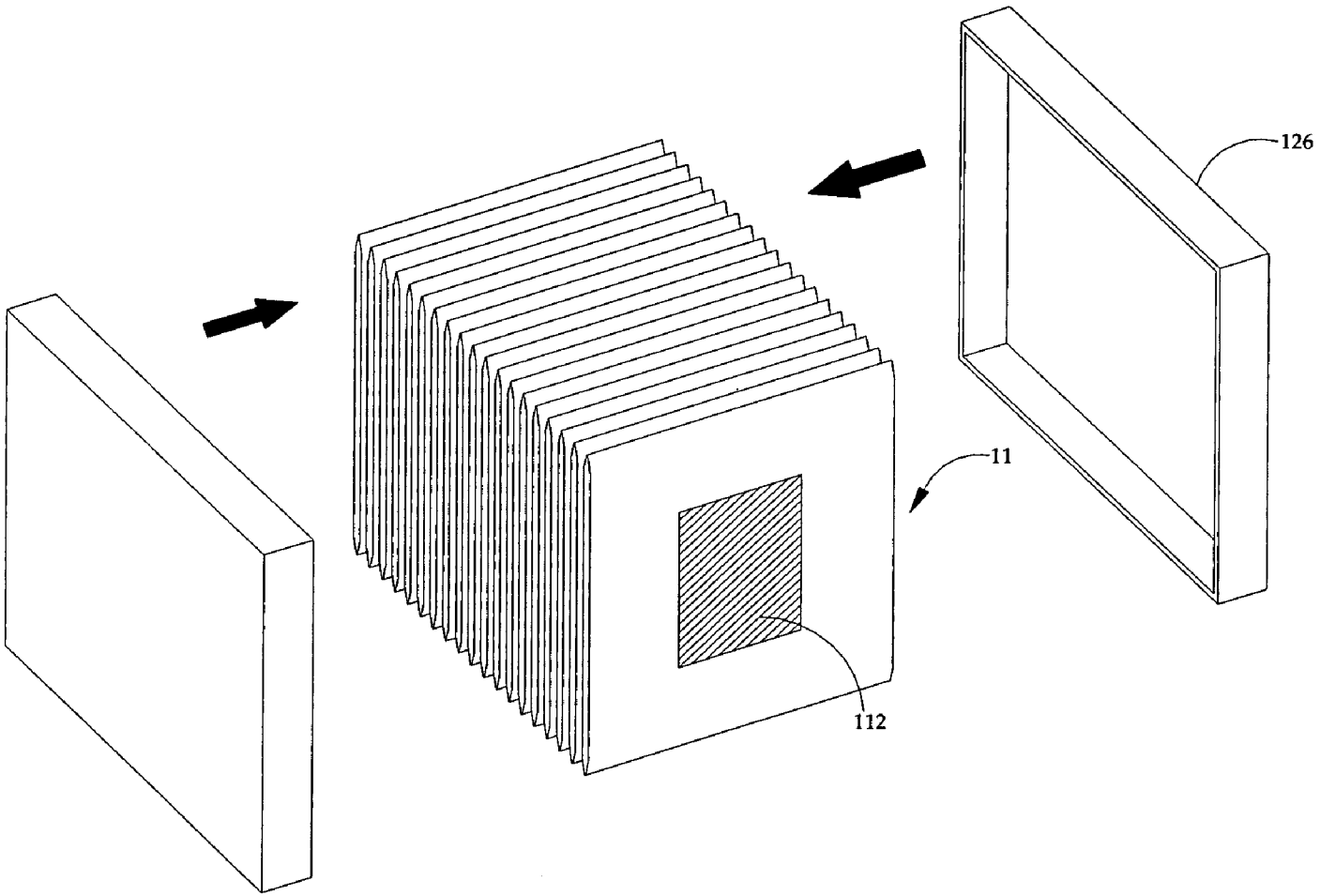
FIG. 6 is a perspective view of another alternative of a knife supporter according to the above preferred embodiment of the present invention.
Figure 6B:
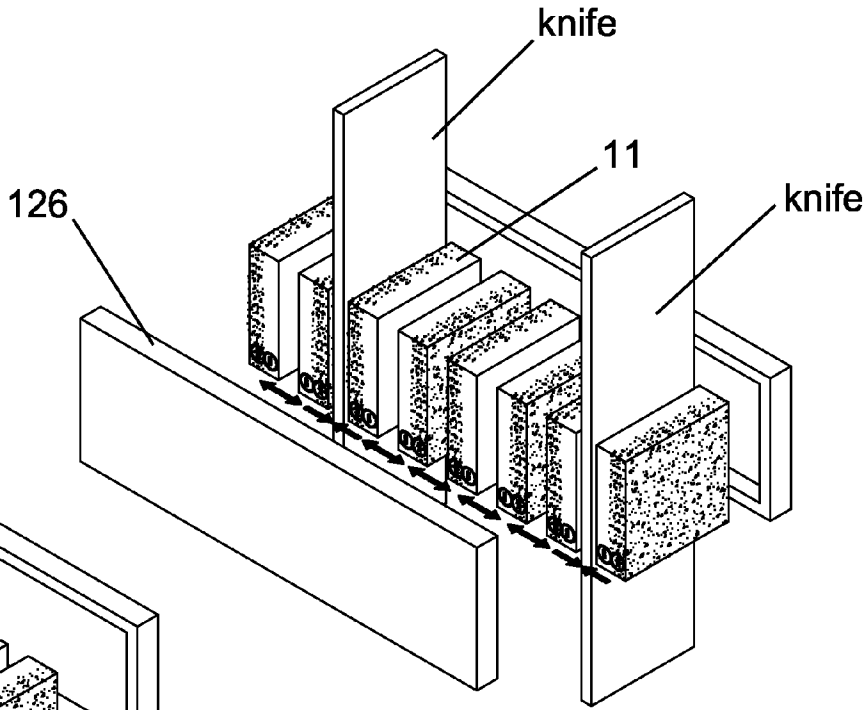
FIGS. 6A-6B are schematic views of the knife supporter according to the above preferred embodiment of the present invention, illustrating attracting a knife thereto.
Figure 6A:
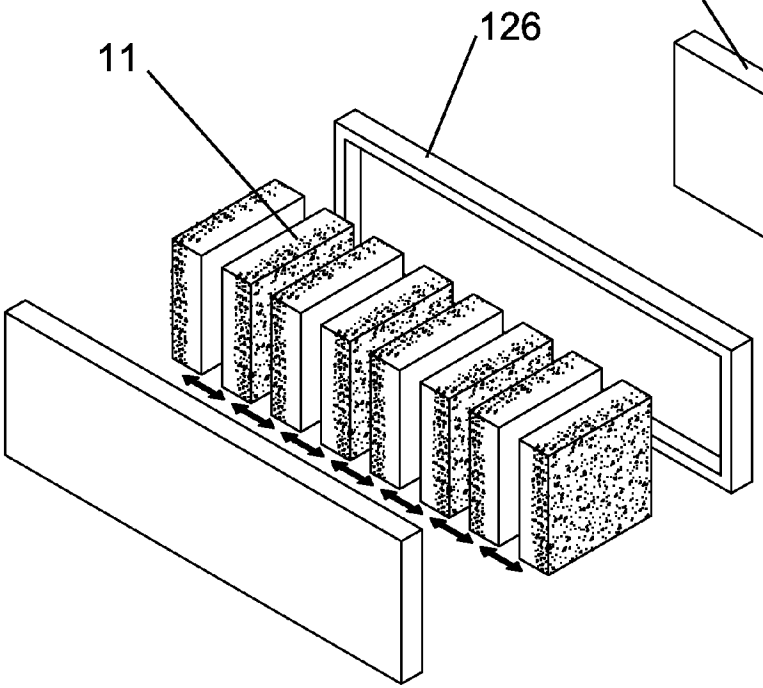

In another alternative, referring to FIG. 6 the supporting frame comprises two side cover that can partially cover each of the magnetic boards at two opposite sides, so that the supporting frame can supports the magnetic boards, and the magnetic board can slide along the cover to clamping knife between the magnetic boards.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A knife supporter, comprising:

at least two magnetic boards having same magnetic polarity facing each other, wherein said magnetic boards repel each other to form a receiving room therebetween for receiving a knife, and a supporting frame slidably supports said magnetic boards, wherein said magnetic boards are capable of sliding along said supporting frame to self adjust a distance therebetween, wherein when no knife is put between said two magnetic boards, said two magnetic boards repel each other to form said receiving room, when the knife is put between said two magnetic boards, said two magnetic boards with magnetism attract the knife in said receiving room and tighten said receiving room to clamp the knife therebetween, when the knife is removed from said two magnetic boards, said two magnetic boards separate to restore said receiving room therebetween due to same magnetic polarity repelling each other, therefore creating a self clamping structure.

2. The knife supporter, as recited in claim 1, wherein said supporting frame comprises a base having two upright side walls spacedly apart from each other, and at least one guiding pole mounted between said two upright side walls; said magnetic boards have at least one hole thereon for receiving said guiding pole passing through, so that said magnetic boards are slidably mounted on said guiding pole on said supporting frame.

3. The knife supporter, as recited in claim 2, wherein said two upright side walls have at least one hole respectively for fixing said guiding pole to said upright side walls.

4. The knife supporter, as recited in claim 3, wherein said supporting frame further comprises at least one screw for securing at least one end of said guiding pole on said upright side wall, and said guiding pole has thread in said end for said screw screwing on.

5. The knife supporter, as recited in claim 4, wherein said base further comprises a bottom plate for supporting said two upright side walls on both ends of said bottom plate respectively.

6. The knife supporter, as recited in claim 4, wherein said magnetic board has a hole and a magnet mounted therein.

7. The knife supporter, as recited in claim 4, wherein said magnetic board is made of a magnet.

8. The knife supporter, as recited in claim 4, wherein said magnetic board comprises a magnet attached thereon, wherein said magnets have same magnetic polarity facing outside.

9. The knife supporter, as recited in claim 1, wherein said supporting frame comprises at least one connecting ring which can connect said magnetic boards on one side forming a circle, and at least one guiding ring guides said magnetic boards on the other side; said magnetic board has at least one hole for connecting ring passing through forming a circle, and said magnetic board further has a groove on the other side for guiding said magnetic boards sliding along said guiding ring.

10. The knife supporter, as recited in claim 9, wherein said that both said connecting ring and the guiding ring have a joint that can detach said claming board therefrom, so that said clamping board can be detached from the supporting frame.

11. The knife supporter, as recited in claim 10, wherein said magnetic board has a hole and a magnet mounted therein.

12. The knife supporter, as recited in claim 10, wherein said magnetic board is made of a magnet.

13. The knife supporter, as recited in claim 10, wherein said magnetic board comprises a magnet attached thereon, wherein said magnets have same magnetic polarity facing outside.

14. The knife supporter, as recited in claim 1, wherein said supporting frame comprises two side cover that can partially cover each of said magnetic boards at two opposite sides, so that said supporting frame can supports said magnetic boards, and said magnetic board can slide along said cover to clamping knife between the magnetic boards.

15. The knife supporter, as recited in claim 14, wherein said magnetic board has a hole and a magnet mounted therein.

16. The knife supporter, as recited in claim 14, wherein said magnetic board is made of a magnet.

17. The knife supporter, as recited in claim 14, wherein said magnetic board comprises a magnet attached thereon, wherein said magnets have same magnetic polarity facing outside.

18. The knife supporter, as recited in claim 1, wherein said magnetic board has a hole and a magnet mounted therein.

19. The knife supporter, as recited in claim 1, wherein said magnetic board is made of a magnet.

20. The knife supporter, as recited in claim 1, wherein said magnetic board comprises a magnet attached thereon, wherein said magnets have same magnetic polarity facing outside.

* * * * *